US006640837B2

(12) United States Patent
Mori et al.

(10) Patent No.: US 6,640,837 B2
(45) Date of Patent: Nov. 4, 2003

(54) SIMPLIFIED BINDING DEVICE USING SPIRAL COIL

(75) Inventors: Makoto Mori, Katsushika-ku (JP); Fumio Shimizu, Katsushika-ku (JP)

(73) Assignee: Carl Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 10/094,960

(22) Filed: Mar. 12, 2002

(65) Prior Publication Data

US 2002/0129865 A1 Sep. 19, 2002

(30) Foreign Application Priority Data

Mar. 15, 2001 (JP) ..... 2001-074047

(51) Int. Cl.[7] ..... B21F 45/16
(52) U.S. Cl. ..... 140/92.3; 140/92.94
(58) Field of Search ..... 140/92.3, 92.9, 140/92.93, 92.94; 29/456, 237.5

(56) References Cited

U.S. PATENT DOCUMENTS 2,638,609 A * 5/1953 Penner ..... 140/92.3
2,808,079 A * 10/1957 Tauber ..... 140/92.3
4,378,822 A 4/1983 Morris
5,785,479 A 7/1998 Battisti et al.
5,934,340 A 8/1999 Anthony, III et al.

* cited by examiner

*Primary Examiner*—Lowell A. Larson
(74) *Attorney, Agent, or Firm*—Oliff & Berridge, PLC

(57) ABSTRACT

A simplified and easy-to-use binding device is provided. A plurality of sheets are bound together by inserting a spiral coil through a series of holes punched in each of the sheets at certain intervals. In a first embodiment, a spiral coil having the same pitch as the interval between the holes is used. In a second embodiment, a densely spiraled coil is used. A coil leading guide is prepared for inserting the densely spiraled coil through the holes in the sheets. The coil leading guide has the same pitch as the interval between the holes, and is coupled to the densely spiraled coil through an engaging portion formed in an end portion of the coil leading guide. The coil leading guide is spirally inserted through the holes such that the densely spiraled coil follows the coil leading guide, whereby the plurality of sheets are bound together. There are further employed a base for retaining the sheets from the backside so as to hold the sheets even at edges, and a coil turning aid for pressing the spiral coil from above and turning it.

4 Claims, 8 Drawing Sheets

SIMPLIFIED BINDING DEVICE USING SPIRAL COIL

BACKGROUND OF THE INVENTION

1. Field of the Invention

The present invention relates to a simplified binding device using a spiral coil.

2. Description of the Related Art

According to one of known bookbinding techniques, a plurality of sheets are bound to one book by punching a series of holes in each sheet at certain intervals and inserting a spiral coil through the series of holes, the spiral coil being coiled at the same constant pitch as the series of holes in each sheet. Major advantages of that bookbinding technique are as follows. First, the bound book can be opened at 360 degrees. Secondly, high durability is ensured by using a coil made of a metal or plastic. Another major advantage is that the production cost can be held down relatively low. Because of a unique structure binding a book with a spiral coil, however, such a bookbinding technique has been long far from being popularly utilized by individual persons as means for binding a book. Also, it is generally known that a binding apparatus using a spiral coil, according to the above-mentioned bookbinding technique, has a difficulty to be put into markets as a handy product for personal use, which is inexpensive and practically usable.

One of binding machines is disclosed in U.S. Pat. No. 4,378,822 issued to Leslie J. Morris in 1983. According to this U.S. patent, a plurality of sheets are bound together with a spiral coil as follows. A stack of sheets are placed on a table and made even at edges using a guide projecting above the table from the side opposed to the bound edges. A manually or electrically driven small-sized coil feeder is provided adjacent to the end of a stack of the sheets, and the coil is driven to be inserted through a series of holes in the sheets while it is spirally turned by a driving mechanism. On that occasion, a mandrel is inserted through the spiral coil so that the coil is spirally turned in a proper manner. However, the binding machine disclosed in that U.S. patent is premised on that the spirally turned coil is always smoothly inserted into the series of holes punched in the sheets. From the technical point of view, the U.S. patent and related apparatuses are generally problematic in that the above premise is not always satisfied. Once the spirally turned coil is dislocated from any of the holes punched in the sheets, the entire binding process comes into an unstable state at once. If such an event occurs, a serious problem arises in the spirally binding process. Further, depending on conditions, some coils have a pitch that is not exactly constant. The mandrel used in the U.S. patent has not succeeded in satisfactorily overcoming the above-mentioned problem. For that reason, when binding sheets together based on the spirally binding process, such means as not only making the stack of sheets even at edges using the guide, but also manually pressing the stack of sheets downward from above, are generally employed so that the coil is inserted through the sheet holes as smooth as possible.

As a solution for the above-described technical problem with U.S. Pat. No. 4,378,822, it is proposed to guide the advance of the spiral coil from side substantially over the entire length of the spiral coil instead of inserting the mandrel through an end portion of the spiral coil. One of such proposals is disclosed in U.S. Pat. No. 5,785,479 issued to Thomas Battisti, et al. in 1998. However, the disclosed solution increases size and complexity of the entire machine due to the necessity of employing a coil guide for setting a position, at which the coil is spirally fed, and another driving mechanism. For the purpose of manufacturing a spirally binding machine, which tends to become large and complex, to be adapted for personal use by individual consumers, U.S. Pat. No. 5,934,340 issued to Phillip M. Anthony, et al. in 1999 proposes a personal binding machine having a smaller size. This U.S. patent also intends to automate the binding process using a microprocessor, etc.

Many patents related to the spirally binding technique are issued as mentioned above. Generally speaking, however, a difficulty still remains in providing, to ordinary consumers, a simplified binding device that is able to realize smooth bookbinding using a spiral coil. In particular, the personal binding machine disclosed in U.S. Pat. No. 5,934,340 cannot be said as being so economical that individual consumers can perform bookbinding work with ease.

Further, a spiral coil has a unique shape and occupies a relatively large space when it is stored in a certain space-limited place. Regarding that point, it has not yet been known to the public to employ a device allowing general consumers to perform bookbinding work using a spiral coil, which is more convenient to carry and is more densely coiled, in a similar manner as an ordinary spiral coil.

SUMMARY OF THE INVENTION

In view of the state of the art set forth above, it is an object of the present invention to provide a simplified binding device, which has a simple structure, is easy to use, and is able to perform bookbinding with a spiral coil including a densely spiraled coil.

To achieve the above object, according to a first aspect of the present invention, there is provided a binding device used when stacking a plurality of sheets each having a series of holes punched at certain intervals, and binding the plurality of sheets together by inserting a spiral coil through each of the holes, wherein the binding device has a working surface brought into contact with the spiral coil for turning the spiral coil.

With those features, when binding a plurality of sheets together by inserting a spiral coil, which has the same pitch as that of a series of holes punched in each of the sheets, through the series of holes in the sheets, the bookbinding operation can be performed with smooth spiral feeding of the spiral coil by employing the binding device, which is preferably a coil turning aid, and bringing it into contact with the spiral coil from above toward below to turn the spiral coil in the direction of the spiral feeding.

According to a second aspect of the present invention, there is provided a binding device comprising a guide for positioning a plurality of stacked sheets, each of which has a series of holes punched at certain intervals, such that the holes in the stacked sheets are aligned with one another, and a plurality of recessed slots formed along a side edge of the binding device at the same interval as that between the holes, the plurality of stacked sheets being bound together by turning a spiral coil to be inserted through each of the holes in a state in which the plurality of stacked sheets are positioned on the binding device such that the holes in the stacked sheets are aligned with the plurality of recessed slots.

With those features, when binding a plurality of sheets together by inserting a spiral coil, which has the same pitch as that of a series of holes punched in each of the sheets, through the series of holes in the sheets, the plurality of sheets can be bound together while preventing the sheets from curling at the lowermost side, by employing the binding device, which is preferably a base. In this case, the bookbinding operation can be more smoothly and quickly performed by combined use with the coil turning aid according to the first aspect of the present invention.

According to a third aspect of the present invention, there is provided a binding device used when stacking a plurality of sheets each having a series of holes punched at certain intervals, and binding the plurality of sheets together by inserting a spiral coil through each of the holes, wherein the binding device has a spiral shape coiled at the same pitch as an interval between the holes, and has an engaging portion formed in at least one end portion thereof for engagement with an end of a densely spiraled coil.

With those features, when binding a plurality of sheets together, the plurality of sheets can be easily bound by inserting the binding device, which is preferably a coil leading guide, along with a densely spiraled coil through a series of holes punched in each of the sheets such that the coil leading guide leads the densely spiraled coil. Further, since the overall length of the densely spiraled coil is reduced to approximately ⅕ of that of the ordinary spiral coil, the binding device is more convenient to carry. In this case, the bookbinding operation can be more smoothly and quickly performed by combined use with the binding devices according to the first and second aspects of the present invention.

According to a fourth aspect of the present invention, the engaging portion of the binding device having a spiral shape, according to the third aspect of the present invention, differs in shape from the end of the densely spiraled coil, and the end of the densely spiraled coil is engaged with the engaging portion of the binding device having a spiral shape through frictional engagement therebetween by inserting the end of the densely spiraled coil into the engaging portion.

With those features, since the densely spiraled coil and the binding device according to the third aspect of the present invention are formed such that the end of the densely spiraled coil and the engaging portion of the binding device have different shapes from each other, the end of the densely spiraled coil can be engaged with the engaging portion of the binding device through frictional engagement between them.

A simplified binding device using a spiral coil, according to the present invention, is basically constructed as set forth above. Additionally, in the binding device according to the first aspect of the present invention, which is preferably the coil turning aid, the working surface may be provided with a rubber-made mat, and the mat surface may be subjected to surface treatment for more smoothly turning the spiral coil. The surface treatment may be practiced so as to form a shallow groove extending in the direction of spiral feeding of the spiral coil. For example, the binding device is formed in the shape of a tracing spatula.

The binding device according to the second aspect of the present invention, which is preferably the base, may have a foldable structure for improving convenience when it is stored. For example, by forming the base to be twice-folded nearly at the center, the base can be stored with higher convenience. A grip may be provided at a side of the base so that a user can more easily carry the base.

In the binding device according to the third aspect of the present invention, which is preferably the coil leading guide, a projection may be provided in the engaging portion to ensure more reliable engagement between the end of the coil leading guide and the end of the densely spiraled coil. Alternatively, an adhesive member may be provided in the engaging portion. In particular, the engaging portion may be provided at each of the opposite ends of the binding device according to the third aspect so that the binding device can be engaged at either end with the densely spiraled coil.

In the binding device according to the fourth aspect of the present invention, the binding device and the densely spiraled coil are engaged with each other through frictional engagement by forming their ends to have different shapes. For example, the frictional engagement may be developed by forming the binding device and the densely spiraled coil to have different radii.

Furthermore, since the above-described various forms of binding devices according to the present invention can be employed in combinations, it is also possible to provide a case for storing those binding devices together.

Figure 13:
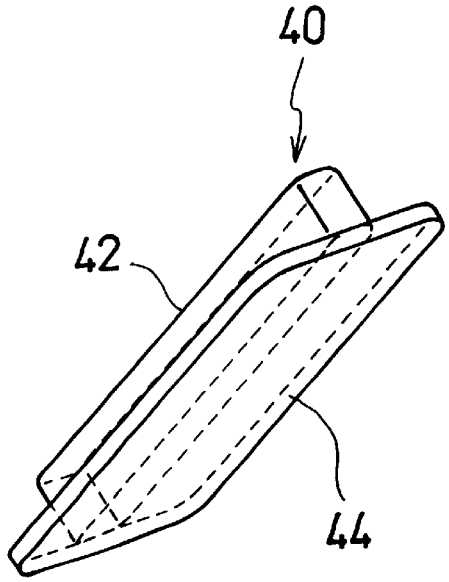

And, FIG. 13 is a perspective view of a coil turning aid according to the present invention.

DESCRIPTION OF THE PREFERRED EMBODIMENTS

Preferred embodiments of the present invention will be described below with reference to the attached drawings.

The present invention provides a binding device for binding a plurality of sheets together, each of which has a series of holes punched at certain intervals. The binding device is practiced in the form of any of a coil leading guide 10, a base 30 and a coil turning aid 40, or in a combination of them.

FIGS. 1 to 6 and 13 represent a first embodiment of the present invention. A simplified binding device of the first embodiment is implemented in combination with a spiral coil 1, which is made of a metal or plastic and is coiled into a spiral shape substantially at the same pitch as the interval between adjacent two of a series of holes 22 punched in each sheet 20.

FIGS. 7 to 12 represent a second embodiment of the present invention. A simplified binding device of the second embodiment is implemented in combination with a densely spiraled coil 2, which is coiled at a pitch different from the interval between adjacent two of the series of holes 22 punched in each sheet 20 and usually has a more compact spiral shape.

The first embodiment of the present invention will be first described.

Figure 1:
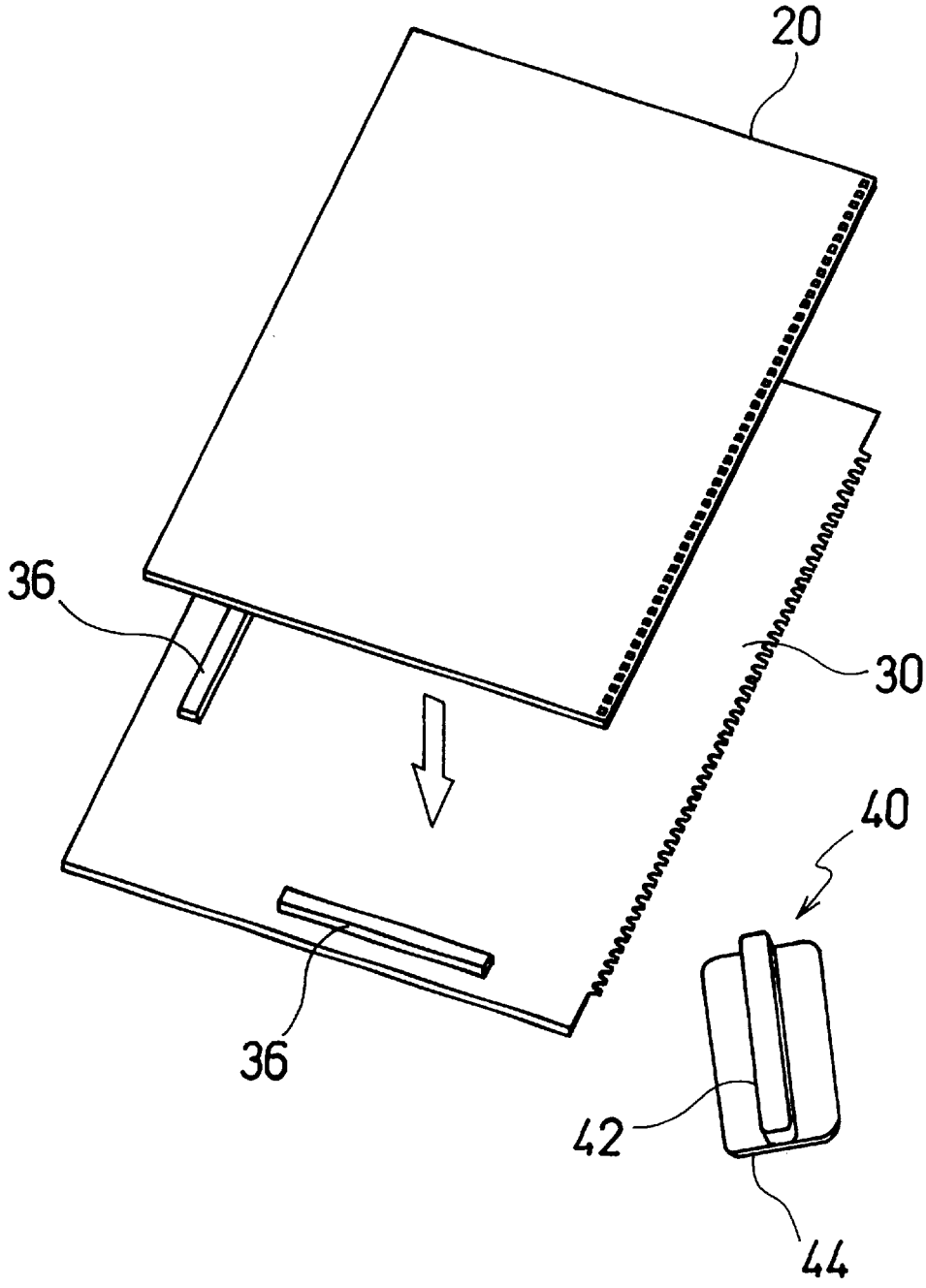
FIG. 1 is a perspective view of a base and a coil turning aid according to the present invention, along with sheets.

FIG. 1 is a perspective view of the base 30 and the coil turning aid 40 according to the first embodiment of the present invention, along with the sheets 20. In each of the sheets 20, a series of holes 22*a*, 22*b*, etc. (see FIG. 2) for use in bookbinding as conventionally are punched beforehand along a side edge at certain intervals. For binding a plurality of sheets 20 together, the series of holes 22 must be positioned one above another in an aligned state through the stacked sheets 20. To that end, the base 30 is employed in the present invention, as shown in FIG. 1. For proper alignment, the base 30 includes at least one guide 36 (see FIG. 1) projected on its working surface. More preferably, two or more guides 36 are provided so that the plurality of sheets 20 are evenly stacked in both the lengthwise and transverse directions. To be adapted for various sizes of sheets, the guide(s) 36 is movable on or detachable from the base 30. Also, to bind the plurality of sheets 20 together at one side, it is sometimes advantageous to slightly lift up the plurality of sheets 20 at that side for convenience of the binding work. For that purpose, the base 30 may be additionally provided on its back surface with a projection (not shown) for supporting the base in a properly inclined state.

Figure 2:
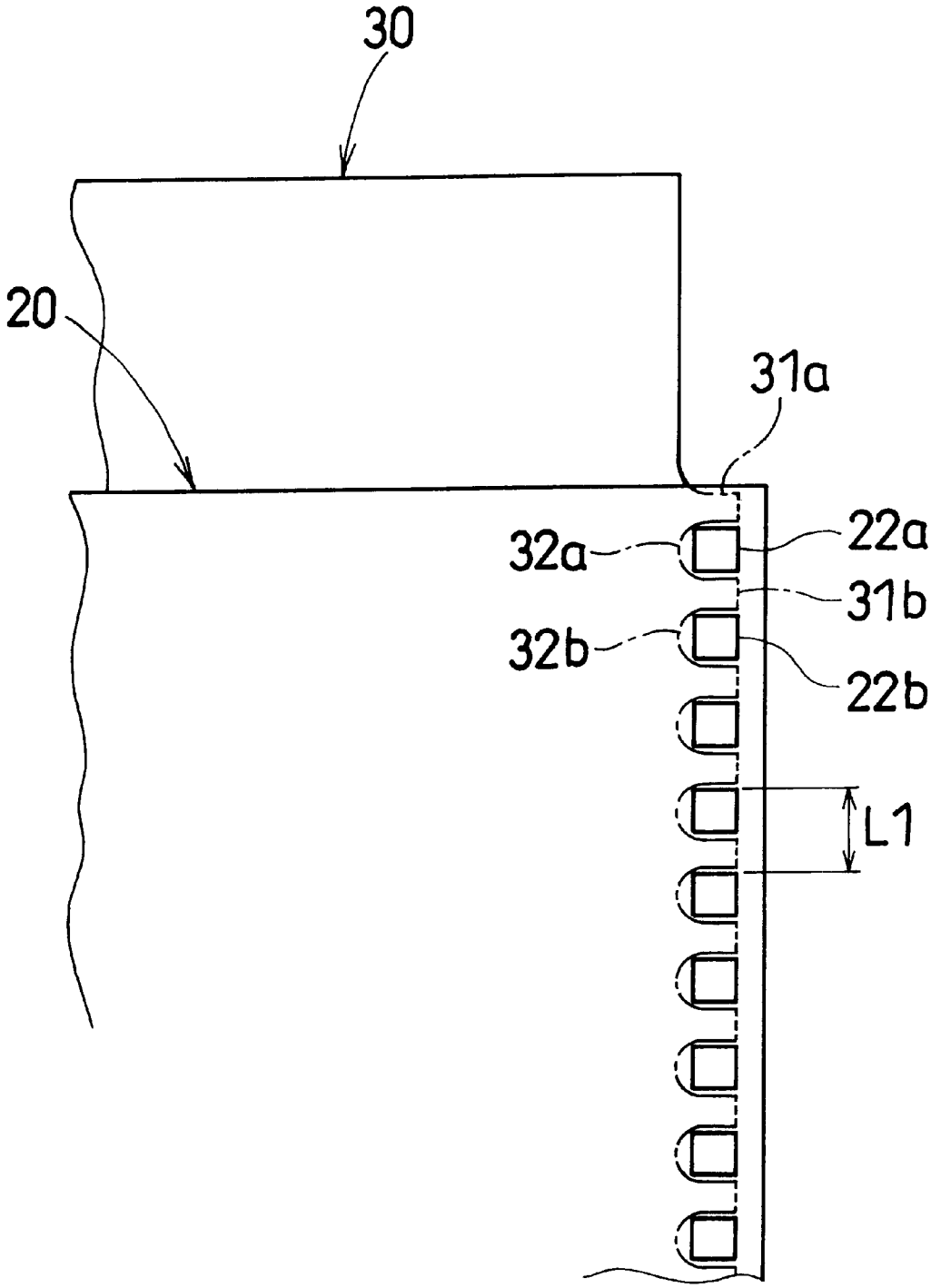
FIG. 2 is an enlarged front view showing a state in which the sheets are stacked on the base according to the present invention.

FIG. 2 is an enlarged front view showing a state in which the sheets 20 are stacked on the base 30. As shown, the base 30 has projected lands 31*a*, 31*b*, etc. and recessed slots 32*a*, 32*b*, etc., which are formed along its one side edge corresponding to the bound side of the sheets 20 at the same certain interval as that between the holes 22 in the sheets 20. More specifically, the recessed slots 32 are formed along one side edge of the base 30 at certain intervals to be aligned with the holes 22 punched in the sheets 20 such that a series of recessed slots 32 are each sandwiched between adjacent two of a series of projected lands 31. Looking at the first recessed slot 32*a*, for example, the recessed slot 32*a* of the base 30 is positioned to be aligned with a first hole 22*a* punched in the sheets 20, and the projected lands 31*a*, 31*b* of the base 30 are positioned on both sides of the first recessed slot 32*a*. In that way, corresponding to the series of holes 22*a*, 22*b*, etc. successively punched in the sheets 20, the recessed slots 32*a*, 32*b*, etc. are formed in the base 30 supporting the sheets 20 from the backside so as to be aligned with the series of holes 22*a*, 22*b*, etc. at the same interval. The projected lands 31*a*, 31*b*, etc. of the base 30 serve to prevent the plurality of stacked sheets 20 from curling at the lowermost side. This is because the base 30 retains the sheets 20 from below.

In order that the base 30 develops the function of retaining the plurality of sheets 20 from below as described above, it is not always required to form the projected lands 31 and the recessed slots 32 in a one-to-one relation to all of the holes 22 punched in the sheets 20. Stated otherwise, the function of preventing the plurality of stacked sheets 20 from curling at the lowermost side can be provided by forming the projected lands 31 and the recessed slots 32 along one side edge of the base 30 at any suitable intervals depending on the interval between the holes 22 punched in the sheets 20. Then, the interval of the projected lands 31 may be set to be the same as a center-to-center distance L1 (see FIG. 2) between the holes 22, or set to be a multiple of the center-to-center distance L1.

Figure 3:
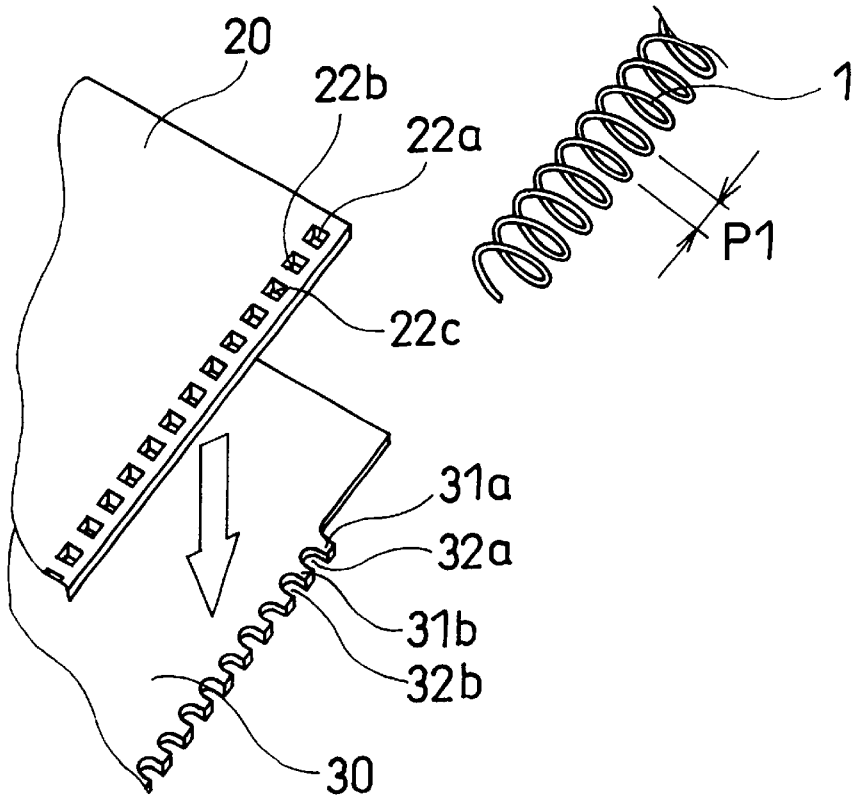
FIG. 3 is a perspective view of a simplified binding device with a spiral coil, according to a first embodiment of the present invention, in a setup state before starting the binding operation.

FIG. 3 is a perspective view showing a setup state immediately before starting the operation of binding the plurality of sheets 20 together on the base 30 with the spiral coil 1.

Usually, for binding the plurality of sheets 20 together, the metal- or plastic-made spiral coil 1 formed into a spiral shape at the certain pitch is inserted through the series of the holes 22. More specifically, assuming that the series of holes 22 are formed at the center-to-center distance L1 (see FIG. 2) of 6 mm, for example, the spiral coil 1 is also formed at a pitch P1 (see FIG. 3) of approximately 6 mm. It is thus preferable that the center-to-center distance L1 between the successive holes 22 is equal to the pitch P1 of the spiral coil 1. Concrete values of L1 and P1 may be changed as appropriate depending on practical applications.

Figure 4:
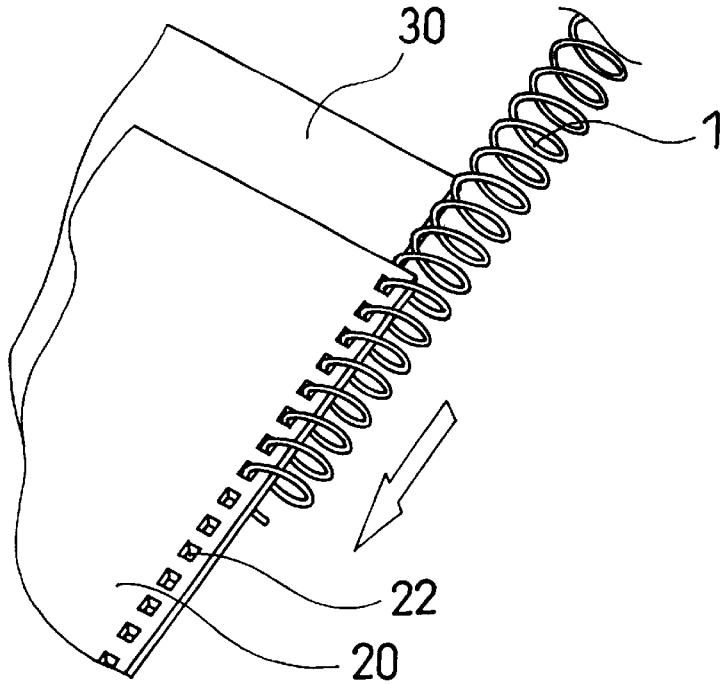
FIG. 4 is a perspective view of the simplified binding device with the spiral coil, according to the first embodiment of the present invention, in a state during the binding operation.

FIG. 4 is a perspective view showing a state during the binding operation, in which the spiral coil 1 shown in FIG. 3 is spirally fed a certain distance through the holes 22 punched in the plurality of sheets 20. Similar binding operation can also be performed without using the base 30. In such a case, however, as the spiral feeding of the spiral coil 1 proceeds, there increases a fear that a lead end of the spirally-fed spiral coil 1 may slightly misalign from the positions of the holes 22 punched in the sheets. Such a misalignment is a serious technical problem that has been regarded as a matter to be overcome in the relevant art including the above-cited U.S. Pat. No. 4,378,822, etc.

For preventing the occurrence of such a misalignment and smoothly binding the plurality of sheets 20 together with the spiral coil 1, the coil turning aid 40 (see FIGS. 1 and 13) is employed in the present invention. As shown in FIGS. 1 and 13, the coil turning aid 40 has a grip 42 provided on its upper surface so that a user can grip the coil turning aid by the hand. Also, preferably, the coil turning aid 40 has a working surface 44 formed at its bottom surface, which is brought into contact with the spiral coil from above for turning it. In a preferable example, the working surface 44 is formed by a rubber-made mat. Further, the grip 42 may be formed in any suitable shape so that the user can easily grip it. For example, the grip 42 may be provided with an opening that allows the user to enter the finger(s) into it. The coil turning aid 40 is brought into contact with nearly the lead end of the spiral coil 1 from above for turning it, thereby keeping the lead end of the spiral coil 1 from dislocating from the holes 22 in the sheets 20 during the spiral feeding. From experiments, it was confirmed that the spiral coil 1 was highly smoothly inserted through the holes 22 in the sheets 20 by using the coil turning aid 40.

Figure 5:
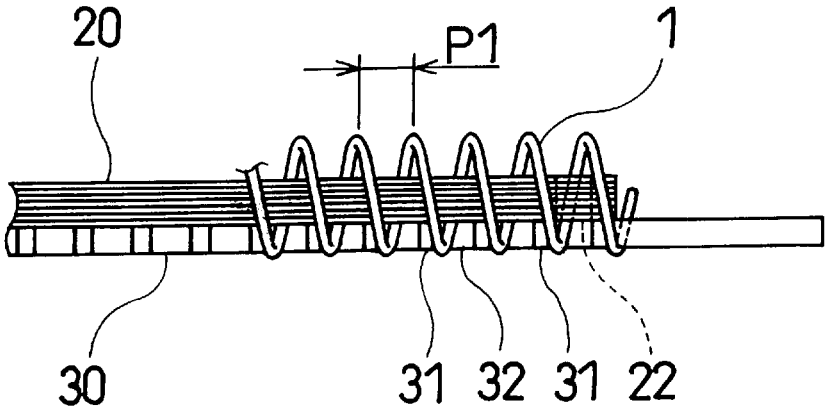
FIG. 5 is an enlarged side view of the simplified binding device with the spiral coil, according to the first embodiment of the present invention, in the state during operation.
Figure 6:
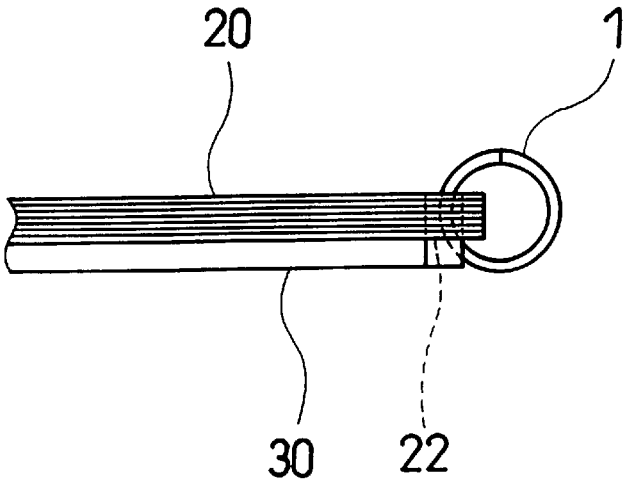
FIG. 6 is an enlarged plan view of the simplified binding device with the spiral coil, according to the first embodiment of the present invention, in the state during operation.

FIG. 5 is an enlarged side view showing the spiral coil 1, the sheets 20 and the base 30 in a state in which the spiral coil 1 is spirally fed a certain distance. As seen from FIG. 5, the spiral coil 1 passes between the projected lands 31 of the base 30, and is inserted through the holes 22 in the sheets 20 through the recessed slots 32. FIG. 6 is a plan view corresponding to FIG. 5. When inserting the spiral coil 1 through the holes 22 in the sheets 20, as shown in FIG. 6, the spiral coil 1 having the constant pitch and the constant radius is inserted through the series of holes 22 in the sheets 20 such that an axis of the spiral coil 1 runs nearby the side edge of a stack of the sheets 20. Therefore, a bound book can be opened at 360 degrees.

Thus, this first embodiment is able to effectively overcome, with a simple construction, the fear that the lead end of the spirally-fed spiral coil may slightly misalign from the positions of the holes punched in the sheets, i.e., the technical problem which has hitherto been left not completely overcome with the binding machine disclosed in the above-cited U.S. Pat. No. 4,378,822, etc., while avoiding the problem in size and complexity of the binding machine as disclosed in the above-cited U.S. Pat. No. 5,934,340, etc.

A second embodiment of the present invention will be described below.

Figure 7:
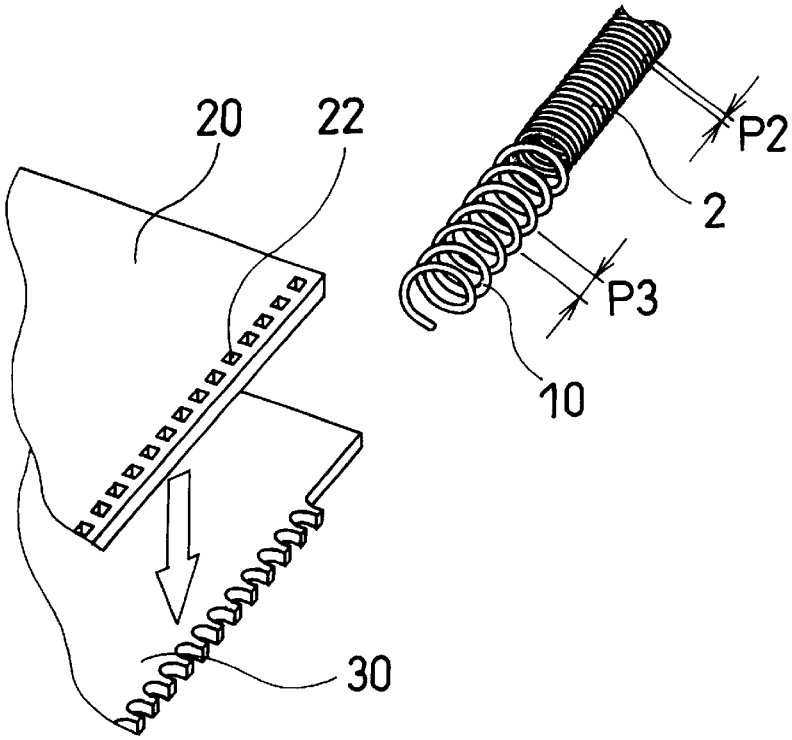
FIG. 7 is a perspective view of a simplified binding device with a spiral coil, according to a second embodiment of the present invention, in a setup state before starting the binding operation.

FIG. 7 is an enlarged perspective view of a binding device according to the second embodiment of the present invention, showing a densely spiraled coil 2, a coil leading guide 10, sheets 20, and a base 30. As with the first embodiment, a series of holes 22 used for bookbinding are punched beforehand along one side edge of each sheet 20. The densely spiraled coil 2 is inserted through the series of holes 22 for binding a plurality of sheets 20 together. Unlike the spiral coil 1, the densely spiraled coil 2 has a pitch P2 different from the interval between adjacent two of the series of holes 22 punched in the sheets 20. More specifically, the densely spiraled coil 2 has a flexibility enough to easily extend and contract, and is coiled such that it is normally held in a densely compacted state. As compared with the spiral coil 1, therefore, the densely spiraled coil 2 has a smaller size and is more convenient to carry. By way of example, the overall length of densely spiraled coil 2 is reduced to about ⅕ of that of the spiral coil 1 that is usually employed. Accordingly, the densely spiraled coil 2 does not need a large storage space and hence improves convenience when carried. Further, the densely spiraled coil 2 is generally thinner and lighter than the spiral coil 1. For smoothly and quickly inserting the densely spiraled coil 2 through the holes 22 of the sheets, the coil leading guide 10 is separately prepared, as shown, in the second embodiment of the present invention.

Unlike the densely spiraled coil 2, the coil leading guide 10 has a pitch P3 equal to the interval of the holes 22 punched in the sheets 20. Also, the coil leading guide 10 has rigidity enough to hold the pitch P3 unchanged such that the constant pitch is always maintained during spiral feeding. To describe features of the coil leading guide 10 in more detail, it has the constant pitch, the constant radius and the constant thickness, and is extended straight in a shape coiled at least several times. Further, an engaging portion 14 (see FIG. 9) is formed at an end of the coil leading guide 10 for engagement with an end of the densely spiraled coil 2. The coil leading guide 10 is preferably formed into a spiral shape by winding it five or six times, but the number of windings may be changed as appropriate depending on practical applications (see FIG. 7). However, it has been experimentally confirmed that a trouble would occur in the function of the coil leading guide 10 if the number of windings is too small or large. In addition, the coil leading guide 10 is formed to have a radius R3 greater than a radius R2 of the densely spiraled coil 2 so that the user is able to more easily grip the coil leading guide 10 and to manipulate it with increased convenience (see FIG. 10). Such a difference in radius simultaneously applies a force for engaging the end of the coil leading guide 10 with the densely spiraled coil 2 as described later. Practically, the coil leading guide 10 is made of a metal, such as aluminum and brass, or a plastic. Using the coil leading guide 10 enables the densely spiraled coil 2 to be reliably inserted through the series of holes 22 punched in the sheets 20.

Figure 9:
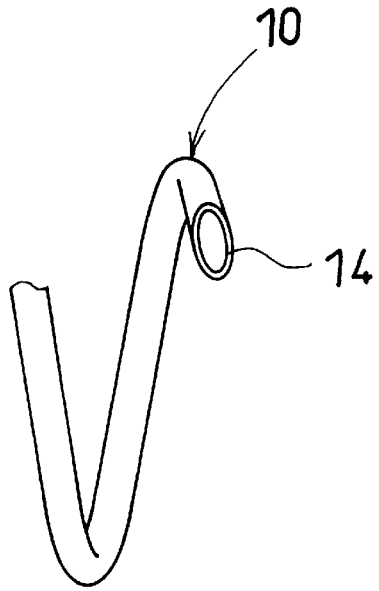
FIG. 9 is an enlarged side view showing an end of a coil leading guide according to the second embodiment of the present invention.
Figure 10:
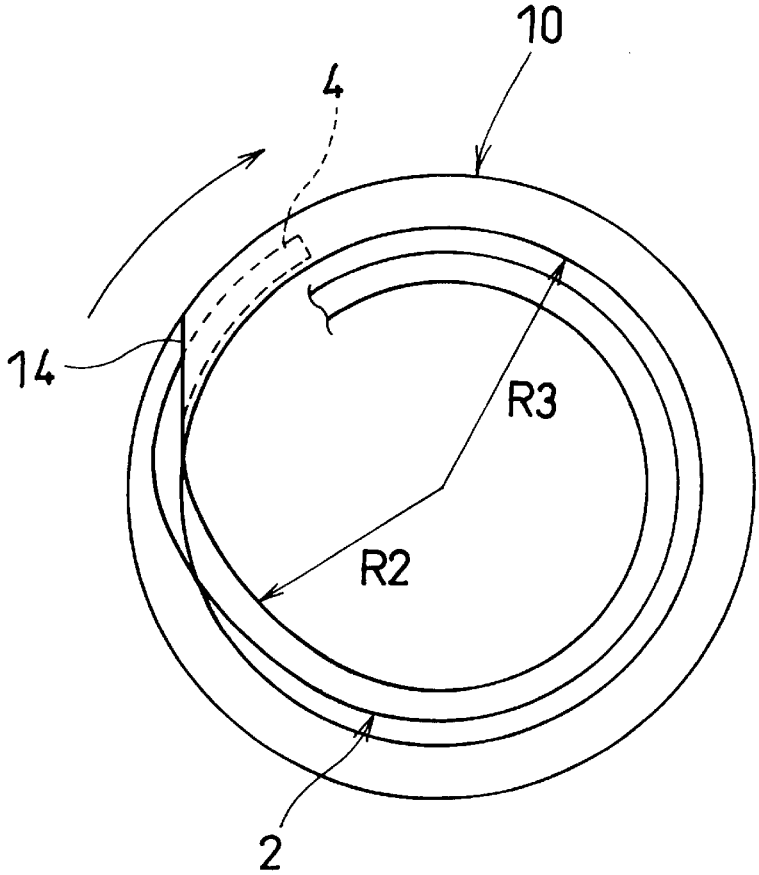
FIG. 10 is an enlarged front view showing engagement between ends of the spiral coil and the coil leading guide according to the second embodiment of the present invention.

The coil leading guide 10 has, as described above, the engaging portion 14 formed in its end portion for coupling to the densely spiraled coil 2. More specifically, as shown in FIGS. 9 and 10, the engaging portion 14 is provided by forming a cavity in the end portion of the coil leading guide 10 such that the cavity ensures engagement with a fore end 4 of the densely spiraled coil 2. That engagement is preferably established with friction developed due to the fact that the radius R3 of the coil leading guide 10 and the radius R2 of the densely spiraled coil 2 differ from each other (see FIG. 10). As will be seen from FIG. 9, the engaging portion 14 is opened in the radial direction with respect to an axis, along which the coil leading guide 10 is spirally fed, for allowing the end of the coil leading guide 10 to be easily engaged with the fore end 4 of the densely spiraled coil 2. With the engaging portion 14 opened in the radial direction, the fore end 4 of the densely spiraled coil 2 can be smoothly inserted into the engaging portion 14 of the coil leading guide 10 (see FIG. 10). FIG. 10 shows a state immediately after inserting the densely spiraled coil 2 into the coil leading guide 10. From the standpoint of reliable operation, the densely spiraled coil 2 is preferably inserted into the coil leading guide 10 up to a deeper position. While the engaging portion 14 is opened outward in FIG. 10 for making the engaging portion 14 opened in the radial direction with respect to the axis, along which the coil leading guide 10 is spirally fed, it may be opened inward conversely. Further, the engaging portion 14 formed in the end portion of the coil leading guide 10 may be chamfered, for example, to realize smoother coupling between the coil leading guide 10 and the densely spiraled coil 2.

Thus, since the end of the coil leading guide 10 and the end of the densely spiraled coil 2 have different shapes from each other, the end of the densely spiraled coil 2 can be engaged with the engaging portion 14 of the coil leading guide (i.e., the binding device having a spiral shape) 10 through frictional engagement between them. In one practical example, as described above, the difference in shape between the end of the densely spiraled coil and the engaging portion of the coil leading guide is provided as a difference in radius therebetween.

Also, to increase the engaging force developed between the engaging portion 14 and the fore end 4, a projection may be provided in the engaging portion 14 to hold the fore end 4 fixed in place, or an adhesive member or the like may be provided in the engaging portion 14 to hold the fore end 4 fixed in place. Alternatively, cutouts may be formed in the engaging portion 14 and the fore end 4, the cutouts being meshed with each other for coupling between them.

Note that the above-described modifications are in common in point of forming the engaging portion 14 in the end portion of the coil leading guide 10.

Figure 8:
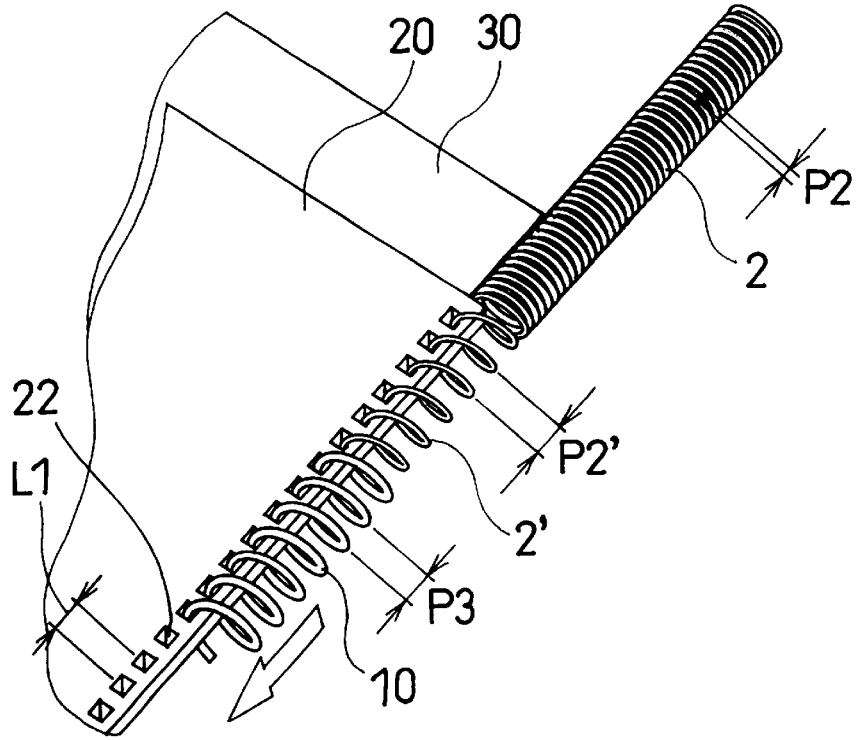
FIG. 8 is a perspective view of the simplified binding device with the spiral coil, according to the second embodiment of the present invention, in a state during the binding operation.

After engaging the fore end 4 and the engaging portion 14 to couple the coil leading guide 10 and the densely spiraled coil 2 with each other, the coil leading guide 10 is inserted through the holes 22 in the sheets 20. That insertion is performed by driving the coil leading guide 10 to spirally advance in a usual manner, FIG. 8 is a perspective view showing a state in which the coil leading guide 10 is spirally fed a certain distance through the holes 22 in the sheets 20. As shown in FIG. 8, the coil leading guide 10 is inserted through the holes 22 while the densely spiraled coil 2 follows the coil leading guide 10, thereby binding the plurality of sheets 20 together. More specifically, by spirally feeding the coil leading guide 10, the densely spiraled coil 2 is inserted through the holes 22 in the sheets 20 such that the pitch P2 of the densely spiraled coil 2 is changed to a pitch P2' substantially equal to the pitch P3 of the coil leading guide 10 (see numeral 2' in FIG. 8). Since the pitch P2' is substantially equal to the center-to-center distance L1 between the holes 22 with the spiral feeding of the coil leading guide 10, the densely spiraled coil 2 can be inserted through the holes 22 in the sheets 20. Thus, although it has been practically impossible to quickly insert the densely spiraled coil 2 through the holes 22 in the sheets 20 by manually driving it without using aids, this embodiment enables the densely spiraled coil 2 to be successively inserted through the holes 22 in the sheets 20 in a simple and effective manner by using the coil leading guide 10. Furthermore, combined use of the coil turning aid 40 with the coil leading guide 10 enables the spiral feeding of the coil leading guide 10 to proceed more quickly. In that case, the binding operation is performed by bringing the coil turning aid 40 into contact with nearly a lead end of the coil leading guide 10 from above toward below, and then turning the coil leading guide 10 in the direction of the spiral feeding.

Figure 11:
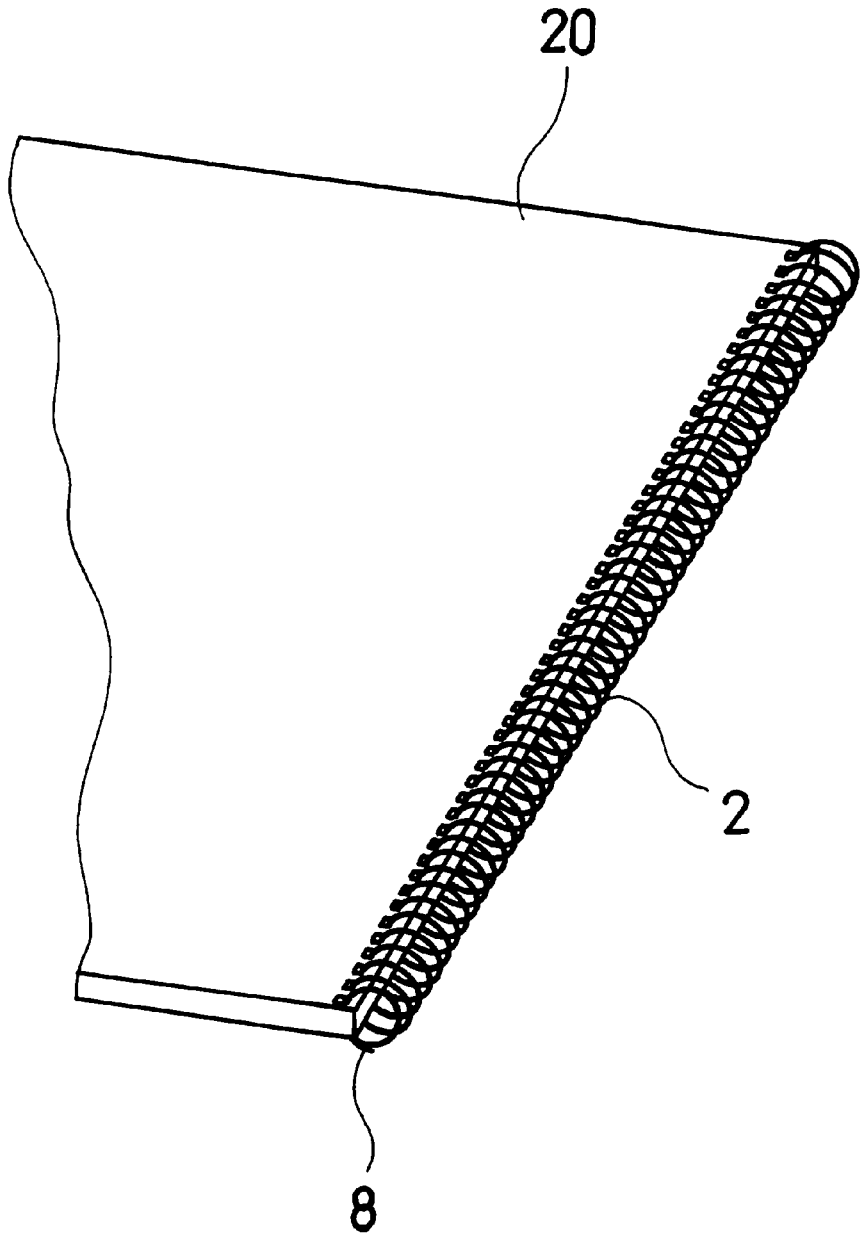
FIG. 11 is a perspective view of the simplified binding device with the spiral coil, according to the second embodiment of the present invention, in an assembled state after the binding operation.
Figure 12:
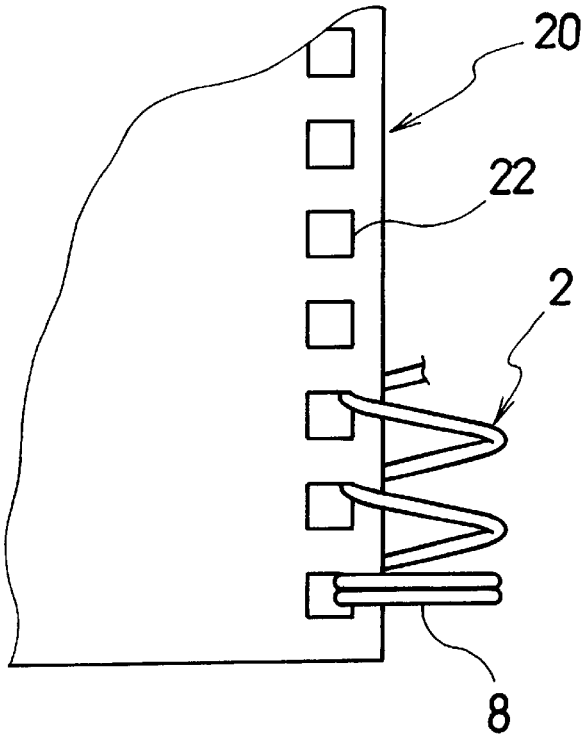
FIG. 12 is an enlarged front view showing an end treating process performed in the present invention.

FIG. 11 is a perspective view showing a state in which the densely spiraled coil 2 is inserted through all of the holes 22 in the sheets 20 and the plurality of sheets 20 bound together. The coil leading guide 10, the base 30 and the coil turning aid 40 are already set aside as soon ad the end of the binding operation. Further, as an end treating process performed on the densely spiraled coil 2 at opposite ends of the sheets 20, the densely spiraled coil 2 is coiled several times through the end 22 at each of the sheets 20 (see numeral 8 in FIGS. 11 and 12). That end treating process is similarly performed in the first embodiment of the present invention as well. When the densely spiraled coil 2 is too long and left unused after binding the sheets 20 together, it may be cut as appropriate at the end of the sheets 20. FIG. 12 is an enlarged front view showing the end treating process performed in the present invention. As shown, preferably, the binding operation is completed by coiling the densely spiraled coil 2 several times through each end hole.

As well known, the end treating process in the relevant art has been conventionally performed by bending each end of a metal- or plastic-made spiral coil. In that case, as a matter of course, the spiral coil is difficult to reuse it. In this second embodiment using the densely spiraled coil 2, the densely spiraled coil 2 can be easily coiled several times through each end hole 22 (see numeral 22*a* in FIGS. 2 and 3) through the sheets 20. It is therefore possible to eliminate the necessity of bending the coil end to complete the end treating process, and to ensure reuse of the coil.

Moreover, by employing the coil turning aid 40 in a similar manner as in the binding operation, the densely spiraled coil 2 can be smoothly removed from the holes 22 in the sheets 20. More specifically, the densely spiraled coil 2 coiled several times is uncoiled from the holes 22 at the opposite ends of the sheets 20. Then, by spirally feeding the densely spiraled coil 2 in a reversed direction, preferably, using the coil turning aid 40, the densely spiraled coil 2 is removed from the plurality of sheets 20.

In a sequence of the operating steps described above, the base 30 and the coil turning aid 40 may be optionally used in combination or omitted, as occasion requires, regardless of which one of the first and second embodiments is implemented. Thus, the present invention provides a spiral coil and a simplified binding device using the spiral coil, which are easy to operate in a very smooth manner and are remarkably economical.

As seen from the above description, the present invention has advantages as follows. According to the first aspect of the present invention, when binding a plurality of sheets together by inserting a spiral coil, which has the same pitch as that of a series of holes punched in each of the sheets, through the series of holes in the sheets, the bookbinding operation can be performed with smooth spiral feeding of the spiral coil by employing a binding device, which is preferably a coil turning aid, and bringing it into contact with the spiral coil to turn the spiral coil.

According to the second aspect of the present invention, when binding a plurality of sheets together by inserting a spiral coil, which has the same pitch as that of a series of holes punched in each of the sheets, through the series of holes in the sheets, the plurality of sheets can be bound together while preventing the sheets from curling at the lowermost side, by employing a binding device, which is preferably a base. In this case, the bookbinding operation can be more smoothly and quickly performed by combined use with the coil turning aid according to the first aspect of the present invention.

Further, according to the third aspect of the present invention, when binding a plurality of sheets together, the plurality of sheets can be easily bound by inserting a binding device, which is preferably a coil leading guide, along with a densely spiraled coil through a series of holes punched in each of the sheets such that the coil leading guide leads the densely spiraled coil. Further, since the overall length of the densely spiraled coil is reduced to approximately ⅕ of that of the ordinary spiral coil, the binding device is more convenient to carry. In this case, the bookbinding operation can be more smoothly and quickly performed with combined use of the binding devices according to the first and second aspects of the present invention.

Still further, according to the fourth aspect of the present invention, the following advantage is obtained in addition to the advantages obtainable with the third aspect of the present invention. The densely spiraled coil and the binding device according to the third aspect of the present invention are formed such that an end of the densely spiraled coil and an engaging portion of the binding device have different shapes from each other, the end of the densely spiraled coil can be engaged with the engaging portion of the binding device through frictional engagement between them.

What is claimed is:

1. A binding device used when stacking a plurality of sheets each having a series of holes punched at certain intervals, and binding the plurality of sheets together by inserting a spiral coil through each of said holes, wherein said binding device has a working surface brought into contact with said spiral coil for turning said spiral coil, a spiral shape coiled at the same pitch as an interval between said holes, and has an engaging portion formed in at least one end portion thereof for engagement with an end of a densely spiraled coil.

2. A binding device according to claim 1, wherein the engaging portion of said binding device having a spiral shape differs in shape from the end of said densely spiraled coil, and the end of said densely spiraled coil is engaged with the engaging portion of said binding device having a spiral shape through frictional engagement therebetween by inserting the end of said densely spiraled coil into the engaging portion.

3. A binding device used when stacking a plurality of sheets each having a series of holes punched at certain intervals, and binding the plurality of sheets together by inserting a spiral coil through each of the holes, comprising:

a guide for positioning a plurality of stacked sheets, each of which has a series of holes punched at certain intervals, such that said holes of the stacked sheets are aligned with one another; and a plurality of recessed slots formed along a side edge of said binding device at the same interval as that between said holes, said plurality of stacked sheets being bound together by turning a spiral coil to be inserted through each of the holes in a state in which said plurality of stacked sheets are positioned on said binding device such that said holes in the stacked sheets are aligned with said plurality of recessed slots, wherein said binding device has a spiral shape coiled at the same pitch as an interval between said holes, and has an engaging portion formed in at least one end portion thereof for engagement with an end of a densely spiraled coil.

4. A binding device according to claim 3, wherein the engaging portion of said binding device having a spiral shape differs in shape from the end of said densely spiraled coil, and the end of said densely spiraled coil is engaged with the engaging portion of said binding device having a spiral shape through frictional engagement therebetween by inserting the end of said densely spiraled coil into the engaging portion.

* * * * *